US006877434B1

(12) United States Patent
McNulty, Jr.

(10) Patent No.: US 6,877,434 B1
(45) Date of Patent: Apr. 12, 2005

(54) MULTI-STAGE PROJECTILE WEAPON FOR IMMOBILIZATION AND CAPTURE

(76) Inventor: James F. McNulty, Jr., 1290 3rd St., Calimesa, CA (US) 92320

( * ) Notice: Subject to any disclaimer, the term of this patent is extended or adjusted under 35 U.S.C. 154(b) by 0 days.

(21) Appl. No.: 10/662,694

(22) Filed: Sep. 13, 2003

(51) Int. Cl.[7] ..... F42B 10/00; F42B 12/00; F42B 14/06; F42B 30/00; F42B 8/00; B64D 1/04; F41F 5/00

(52) U.S. Cl. ..... 102/502; 89/1.11

(58) Field of Search ..... 89/1.11; 102/502

(56) References Cited

U.S. PATENT DOCUMENTS 3,523,538 A * 8/1970 Kunio ..... 607/58
3,803,463 A * 4/1974 Cover ..... 361/232
5,698,815 A * 12/1997 Ragner ..... 102/502
5,831,199 A * 11/1998 McNulty et al. ..... 89/1.11
5,962,806 A * 10/1999 Coakley et al. ..... 102/502

* cited by examiner

*Primary Examiner*—Michael J. Carone
*Assistant Examiner*—H. A. Blackner
(74) *Attorney, Agent, or Firm*—Leonard Tachner

(57) ABSTRACT

Two distinct projectile stages are employed in a projectile configured to be fired at a remote target from a rifle, grenade launcher, gas gun or the like. A first stage comprises a pair of wire tethered contact darts for applying an immobilizing electrical discharge to the target. The second stage comprises a battery, circuits, transformer and wires used to generate a high voltage pulsed signal and apply it to the contact darts in the first stage. The higher mass of the second stage impacts the lower mass first stage at launch causing the first stage to be propelled to the target while the slower second stage hits the ground short of the target.

12 Claims, 2 Drawing Sheets

MULTI-STAGE PROJECTILE WEAPON FOR IMMOBILIZATION AND CAPTURE

BACKGROUND OF THE INVENTION

1. Field of the Invention

This invention relates generally to the field of non-lethal weapons for immobilizing a live target for capture and more specifically to such a weapon having a projectile and configured for long distance usage preferably from a shotgun, grenade launcher or gas gun and having wires tethered to a high voltage source and a pair of connectors for applying the voltage across the target, the distance between the connectors on the target being substantially constant irrespective of distance to the target. The voltage source is placed in a first projectile stage and the pair of connectors is placed in a second projectile stage.

2. Prior Art

The principal prior art relevant to the present invention is disclosed in U.S. Pat. No. 5,831,190. The extensive prior art discussion therein is hereby incorporated herein by reference. The '199 patent discloses the novel concept of employing a relatively large wire-tethered projectile launched from a rifle, grenade launcher or gas gun and having a first connector extending from the projectile in fixed relation thereto and having a second connector that is automatically launched from the projectile by a secondary propulsion device at or near the target to assure proper spacing between the connectors irrespective of the distance to the target from the original projectile launch point. A potentially convenient method for launching such a projectile would be as described at column 14, lines 21–25 of the '199 patent and with the electronics located and remaining in the casing. However, after such a cartridge is fired, wires would then extend through the bore of the large bore long arm so, that a high voltage source contained in the casing which remains in the firearm is in electrical continuity with the connectors of the projectile wherein an immobilizing electrical discharge is applied between the connectors after they engage a live target. The principal advantage of that invention is that unlike prior TASER® weapons, the spacing between the connectors at the target is not dependent upon the distance traveled by the projectile. One disadvantage of such described invention is that as disclosed, no method is described for clearing the wiring from the firearm's bore after the projectile is successfully deployed. Manual extraction would likely be quite cumbersome. Moreover, the length of the wires that can be stored in the casing or projectile constitutes a still severe distance limitation for projectile travel from the launcher. These factors may both impact the launching firearm's configuration and/or limit the range of the weapon.

One alternative for overcoming these disadvantages is to increase the volume of the projectile to accommodate the voltage source as well. However, adding a battery and a transformer to the projectile also significantly increases the mass of the projectile. While such an increased mass projectile can be readily fired by grenade launchers and gas guns, the potential risk for lethal impact by such a larger mass projectile at high speed makes it an undesirable concept. Impacting a live target with a projectile that is heavy enough and traveling fast enough to cause death even some of the time, would essentially defeat the concept of non-lethal immobilization.

Therefore, it would be highly advantageous to provide a weapon of the type disclosed in Applicant's prior issued U.S. Pat. No. 5,831,199 which deploys the voltage source in the projectile fired by the rifle, but without incurring the high risk of lethality that a high speed, heavy projectile would create. Such an improved weapon is the principal object of the present invention.

SUMMARY OF THE INVENTION

The present invention is intended primarily as an improved version of the weapon disclosed in Applicant's prior issued U.S. Pat. No. 5,831,199. In the preferred embodiment of the present invention, the projectile of the '199 disclosure has been modified so that as it leaves the rifle, grenade launcher, gas gun or the like, like the Colt M203 grenade launcher, the Federal Model 203A gas gun and/or the Smith & Wesson Models 210, 276 and 209 gas guns, the projectile contains all of the components needed to impart a high voltage discharge onto a remote target. The battery, circuitry, transformer, wires and connectors are all contained in the projectile, thereby obviating any requirement to modify the launcher (rifle, etc.) to accommodate the high voltage source and the wires.

The improved projectile comprises two distinct stages. One stage (first stage) is effectively a duplicate of the entire projectile disclosed in the '199 patent. It contains the two connectors, one affixed to the front of the projectile and the other configured to be separately launched at or near the target to provide the desired spacing on the target. The other stage (second stage) contains the battery, the circuits and the transformer used to generate the high voltage and the wires that are tethered to the first stage connectors. The mass of the first stage is preferably about 10 grams, thereby avoiding the potential lethal impact with the target that a heavier projectile could cause, especially at close range. The second stage mass is preferably about 100 grams. However, this larger mass is designed to be diverted toward the ground short of the target and not actually impact the target. Gravity may be assisted by aerodynamic features of the second stage housing or devices contained thereon. The explosive impact of the launch from the rifle, grenade launcher, gas gun or the like, initially causes acceleration of the larger mass second stage. The second stage immediately thereafter impacts the first stage. An essentially elastic collision occurs.

The impulse momentum initially imparted to the second stage is thus transferred to the first stage thereby slowing the second stage. Because of the large difference in their respective masses, the respective initial velocities of the two stages after launch is completed are also quite different. The initial velocity of the large mass second stage will be significantly less than the initial velocity of the small mass first stage. Consequently, the second stage will traverse a much shorter aerodynamic path than the first stage. Therefore, the electrical contacts will impact the distant target while the voltage source, while still being tethered by wires to the contacts in the first stage, will fall short of the target.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
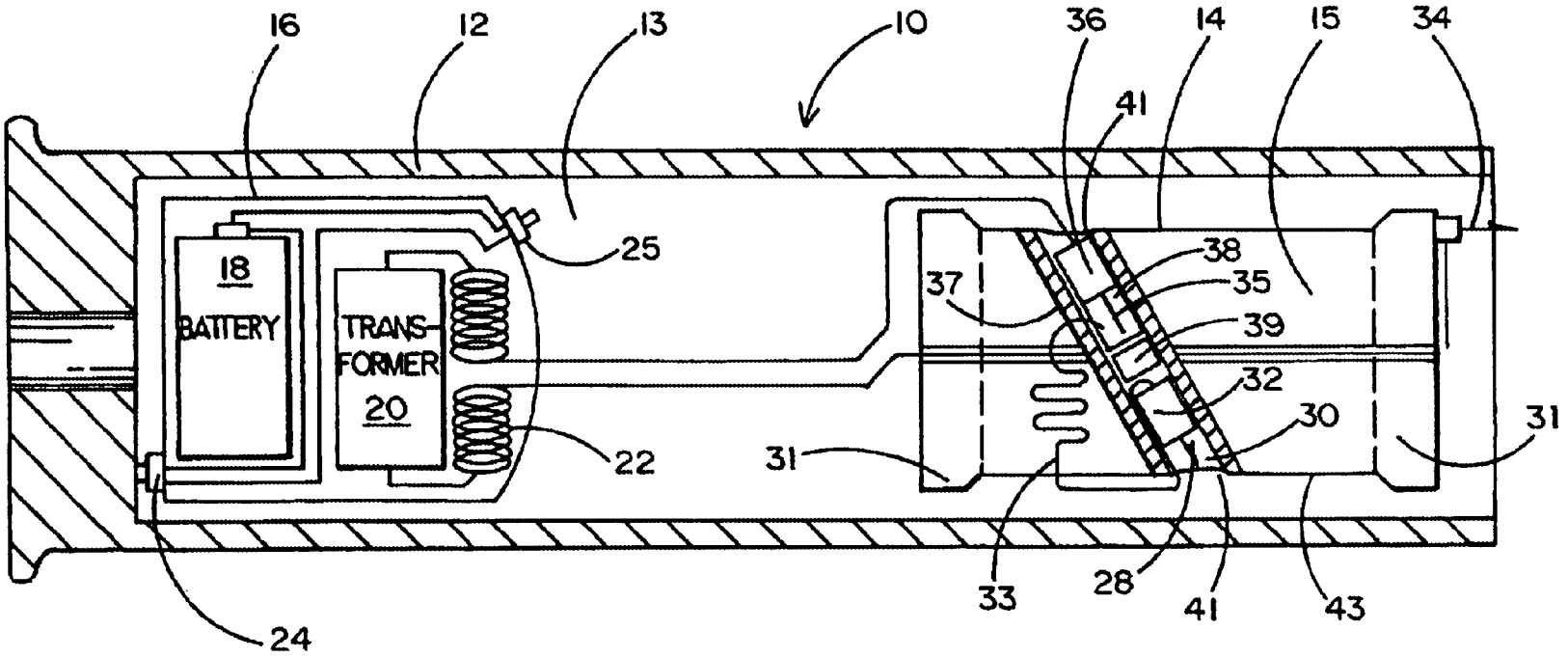
FIG. 1 is a cross-sectional view of an exemplary embodiment of a multistage projectile in accordance with the present invention.

Referring to the accompanying drawings and initially to FIG. 1 in particular, it will be seen that an exemplary embodiment of a multistage projectile 10 is shown therein. Projectile 10 comprises a case 12 forming a hollow cylindrical interior chamber 13. Within chamber are positioned a first stage projectile 14 and a second stage projectile 16.

First stage projectile 14 is configured and functions in the manner described in the disclosure of issued U.S. Pat. No. 5,831,199 the content of which is hereby expressly incorporated herein by reference as if fully set forth herein. For purposes of convenience it will be observed that the principal features of first stage projectile 14 are shown herein in FIG. 1. More specifically, it will be seen that projectile 14 comprises a generally cylindrical body 15 having end caps 31 and having an intermediately located metalized diagonal passage 30. Within passage lies a connector body 32 terminating in a connector 28. Also within passage 30 and behind connector body 32 are a primer 36, a styrofoam portion 38 and a foam wad 39 in mechanically serial arrangement. A first pin 35 is embedded in styrofoam portion 38 and a second pin 37 extends into passage 30 adjacent styrofoam portion 38. A wire tether 33 is connected between second pin. 37 and connector body 32. A metal foil 43 is positioned between end cap 31 and the metalized passage 30. A Mylar tape 41 covers the ends of the passage 30. As described in more detail in the '199 patent specification, after the first projectile contacts a remote target 40, an electrical path is created through a fixed connector 34, the target 40, foil 43 and metalized passage 30 to ignite primer 36 and propel connector body 32 diagonally through passage 30 and Mylar film cover 41. This causes connector 28 to impact and attach to the target 40 at a location spaced from the fixed connector 34. Connector 28 is then electrically connected by means of wire tether 33 and pins 35 and 37 to one side of primary high voltage source while connector 34 is connected to the other side of the high voltage source.

In contrast to the disclosure of the '199 patent where connectors 28 and 34 are connected to a high voltage source in the firing weapon (i.e., rifle, shotgun, grenade launcher, gas gun, etc.) by tethering wires extending the full distance between the weapon and the target, the present invention provides a second stage projectile 16 which contains the voltage source and wires. As seen in FIG. 1, case 12 also contains second stage projectile 16 which houses a battery 18, a transformer 20, circuitry and insulated tether wires 22. A pair of switches 24 and 25 facilitate assembly of the second stage projectile 16 within case 12. Switch 24 is a normally closed switch that is switched to an open configuration when projectile 16 engages the rear interior surface of case 12. It will regain its normally closed condition when projectile 16 separates from case 12. Switch 25 is a normally opened switch and remains in its open condition until projectile 16 is installed into case 12 so that there is no premature connection between the battery 18 and the transformer 20. After installation of projectile 16 into case 12, switch 24 takes over the role of assuring that there is no premature connection from battery 18 to transformer 20 and switch 25 is then switched into a closed configuration so that upon separation of projectile 16 from case 12, the battery is then connected electrically to transformer 20 and high voltage is available between tether wires 22.

Figure 2:
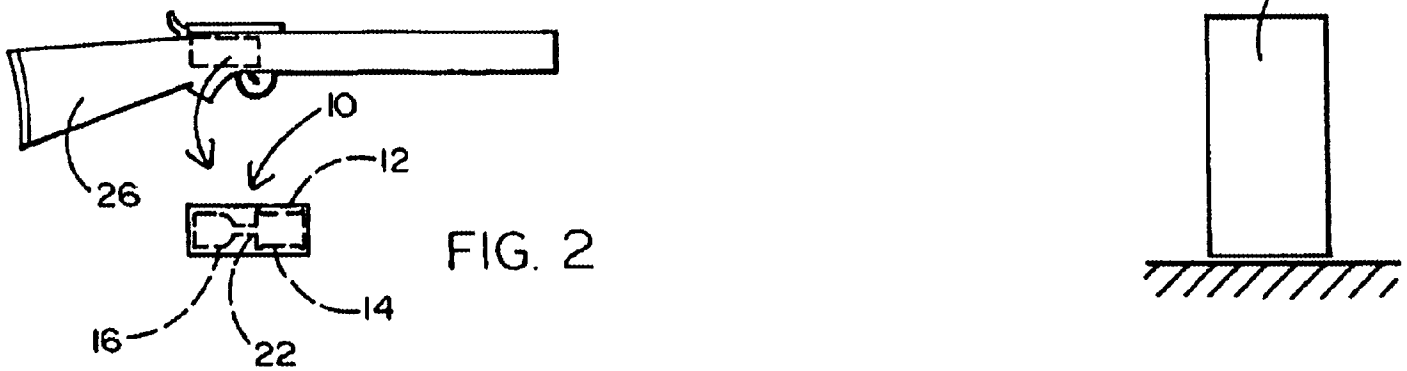
FIG. 2 is a simplified illustration of a weapon utilizing the present invention shown prior to firing at a remote target.
Figure 3:
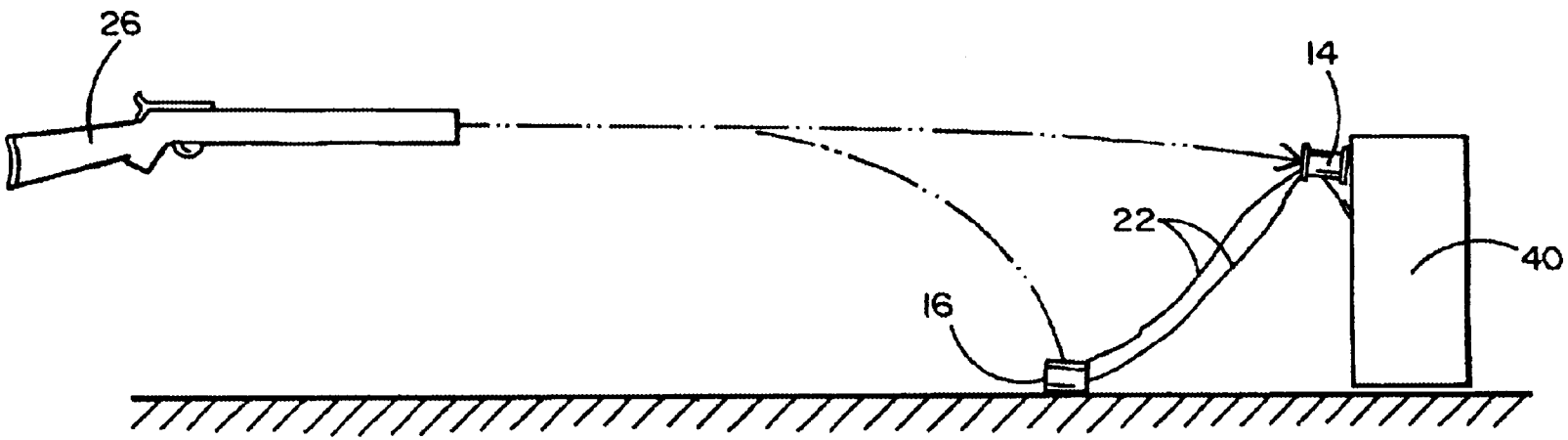
FIG. 3 is a simplified illustration similar to that of FIG. 2 but shown after firing.

Referring now to FIGS. 2 and 3, it will be seen that multistage projectile 10 and is initially breech loaded into gas gun 26 for firing from gas gun 26 toward a remote target 40. Stages 14 and 16 are self-contained within case 12 and are interconnected electrically only to each other by wires 22. After firing, stages 14 and 16 travel toward the target. Second stage 16, initially propelled by the ignition of the pyrotechnic charge in the casing (not illustrated), impacted first stage 14 and both stages have been launched out of the gas gun 26. However, because of the large disparity in respective masses (i.e., second stage 16 being about 10 times the mass of first stage 14), the initial velocity of the first stage was significantly greater than that of the second stage. Assuming that about one-half the momentum of the second stage 16 is transferred to the first stage 14 when the former impacts the latter, the initial velocity of the first stage will be about ten times greater than the velocity of the second stage as both stages exit the case. Consequently, the lighter first stage 14 will travel much faster and much further than the heavier second stage 16 and second stage 16 will hit the ground well before it can reach the target while the first stage 14 will hit the target before its height above the ground can decrease to any significant extent. Thus, although the total mass of the projectile fired from the rifle is at least 110 grams, the portion which impacts the target is only about 10 grams which is sufficiently low to avoid permanent injury to a live target. Therefore, it will be understood that the present invention constitutes a significant improvement over the invention disclosed in the '199 patent.

Having thus disclosed an exemplary embodiment of the invention, those having skill in the relevant art will now perceive various modifications and additions which may be made to the disclosed embodiment. By way of example, the heavier second stage may be modified to have aerodynamic braking devices which would further assure that it would not reach an intended target. Accordingly, such modifications and additions are deemed to be within the scope hereof which shall be limited only by the appended claims and their equivalents.

I claim:

1. A multistage projectile for firing from a weapon for immobilization of a remote target; the projectile comprising:

a first stage having at lest one electrical contact for discharging electrical energy into the target; and a second stage positioned behind said first stage and having a high voltage source and at least one wire tether connected to said first stage for transmitting said electrical energy to said electrical contact.

2. The multistage projectile recited in claim 1 further comprising a case, said case housing said first stage and said second stage.

3. The multistage projectile recited in claim 1 wherein said second stage high voltage source comprises a transformer.

4. The multistage projectile recited in claim 1 wherein said second stage high voltage source comprises a battery.

5. The multistage projectile recited in claim 1 wherein said first stage has two of said electrical contacts and wherein said second stage has two of said wire tethers.

6. The multistage projectile recited in claim 2 wherein said first and second stages are positioned apart relation within said case.

7. The multistage projectile recited in claim 2 wherein said case is shaped as a hollow circular cylinder.

8. The multistage projectile recited in claim 1 wherein said second stage has a mass that is greater than the mass of said first stage.

9. The multistage projectile recited in claim 1 wherein said second stage has a mass which is at least ten times the mass of said first stage.

10. The multistage projectile in claim 1 wherein said first stage has a mass that is no greater than about 10 grams.

11. The multistage projectile recited in claim 1 wherein said first and second stages have different aerodynamic characteristics.

12. The multistage projectile recited in claim 1 further comprising at least one electrical switch for selectively disabling said high voltage source until said projectile is fired from a weapon.

* * * * *